US007405411B2

(12) United States Patent
Walton

(10) Patent No.: US 7,405,411 B2
(45) Date of Patent: Jul. 29, 2008

(54) ION SOURCE WITH MULTI-PIECE OUTER CATHODE

(75) Inventor: Hugh A. Walton, Davisburg, MI (US)

(73) Assignee: Guardian Industries Corp., Auburn Hills, MI (US)

( * ) Notice: Subject to any disclaimer, the term of this patent is extended or adjusted under 35 U.S.C. 154(b) by 278 days.

(21) Appl. No.: 11/123,228

(22) Filed: May 6, 2005

(65) Prior Publication Data

US 2006/0249376 A1 Nov. 9, 2006

(51) Int. Cl.
*H01J 29/04* (2006.01)

(52) U.S. Cl. ..... 250/423 R; 250/427; 250/424; 250/492.3; 250/426; 315/111.81; 315/111.21; 315/111.91; 315/111.41; 313/361.1; 313/359.1; 313/154; 313/161

(58) Field of Classification Search ..... 315/111.81, 315/111.21, 111.91, 111.41; 250/423 R, 250/298.19, 298.14, 427, 424, 426, 492.23; 313/111.91, 361.1, 359.1, 154.161
See application file for complete search history.

(56) References Cited

U.S. PATENT DOCUMENTS 5,646,476 A * 7/1997 Aston ..... 313/359.1
5,656,819 A 8/1997 Greenly
5,763,989 A * 6/1998 Kaufman ..... 313/361.1
6,002,208 A * 12/1999 Maishev et al. ..... 315/111.91
6,037,717 A 3/2000 Maishev et al.
6,147,354 A * 11/2000 Maishev et al. ..... 250/423 R
6,359,388 B1 3/2002 Petrmichl
RE38,358 E 12/2003 Petrmichl
6,740,211 B2 5/2004 Thomsen et al.
6,777,030 B2 8/2004 Veerasamy et al.
6,815,690 B2 * 11/2004 Veerasamy et al. ..... 250/423 R
6,864,486 B2 * 3/2005 Alekseev et al. ..... 250/423 R
7,030,390 B2 * 4/2006 Veerasamy et al. ..... 250/423 R
7,183,559 B2 * 2/2007 Luten et al. ..... 250/423 R
2003/0077402 A1 4/2003 Amann et al.
2004/0016640 A1 * 1/2004 Veerasamy et al. ..... 204/298.19
2004/0074444 A1 4/2004 Veerasamy et al.
2004/0075060 A1 4/2004 Luten et al.
2004/0195521 A1 * 10/2004 Alekseev et al. ..... 250/423 R
2005/0057166 A1 3/2005 Siegfried et al.
2005/0104007 A1 * 5/2005 Veerasamy et al. ..... 250/423 R
2006/0103319 A1 * 5/2006 Luten et al. ..... 315/111.81

* cited by examiner

*Primary Examiner*—Jack I. Berman
*Assistant Examiner*—Michael Maskell
(74) *Attorney, Agent, or Firm*—Nixon & Vanderhye P.C.

(57) ABSTRACT

In certain example embodiments of this invention, there is provided an ion source including an anode and a cathode. In certain example embodiments, a multi-piece outer cathode is provided. The multi-piece outer cathode allows precision adjustments to be made, thereby permitting adjustment of the magnetic gap between the inner and outer cathodes. This allows improved performance to be realized, and/or prolonged operating life of certain components. This may also permit multiple types of gap adjustment to be performed with different sized outer cathode end pieces. In certain example embodiments, cathode fabrication costs may also be reduced.

19 Claims, 5 Drawing Sheets

ION SOURCE WITH MULTI-PIECE OUTER CATHODE

This invention relates to an ion source having an improved cathode design. In certain example embodiments, the ion source comprises a multi-piece outer cathode.

BACKGROUND OF THE INVENTION

An ion source is a device that causes gas molecules to be ionized and then accelerates and emits the ionized gas molecules and/or atoms toward a substrate. Such an ion source may be used for various purposes, including but not limited to cleaning a substrate, surface activation, polishing, etching, and/or deposition of thin film coatings/layer(s). Example ion sources are disclosed, for example, in U.S. Pat. Nos. 6,359,388; 6,037,717; 6,002,208; 5,656,819, 6,815,690, Ser. Nos. 10/986,456, and 10/419,990, the disclosures of which are all hereby incorporated herein by reference.

FIGS. 1-3 illustrate a conventional Hall-effect, cold cathode, closed-drift type ion source. In particular, FIG. 1 is a side cross-sectional view of an ion beam source with an ion beam emitting slit defined in the cathode, FIG. 2 is a corresponding sectional plan view along section line II-II of FIG. 1, and FIG. 3 is a corresponding sectional plan view along section line III-III of FIG. 1. As can be seen in FIGS. 2-3, the ion source may have an oval and/or racetrack-shaped ion beam emitting slit although other types of slits such as a circular slit may instead be used. Other suitable shapes may also be used.

Referring to FIGS. 1-3, the ion source includes a hollow housing made of a highly magnetoconductive (or permeable) material such as iron, which is used as a cathode 5. The cathode 5 includes each of an inner cathode 5*a* and a one-piece outer cathode 5*b*. The outer cathode 5*b* may include cylindrical or oval side wall 7 and a closed or partially closed bottom wall 9; whereas the inner cathode 5*a* includes an approximately flat top wall 11 in which a circular or oval ion emitting slit and/or aperture 15 is defined. The slit 15 is defined at least partially between the inner cathode 5*a* and the one-piece outer cathode 5*b*. The bottom 9 and side wall(s) 7 of the cathode are optional. Ion emitting slit/aperture 15 includes an inner periphery as well as an outer periphery.

Deposition and/or plasma maintenance gas supply aperture or hole(s) 21 is/are formed in bottom wall 9. The flat top wall of the cathode functions as an accelerating electrode. A magnetic system including a cylindrical permanent magnet(s) 23 with poles N and S of opposite polarity is placed inside the housing between bottom wall 9 and top wall 11. The purpose of the magnetic system with a closed magnetic circuit formed by the magnet 23 and cathode 5 is to induce a substantially transverse magnetic field (MF) in an area proximate ion emitting slit 15. The ion source may be entirely or partially within a wall 50. In certain instances, wall 50 may entirely surround the source and substrate 45, while in other instances the wall 50 may only partially surround the ion source and/or substrate.

A circular or oval shaped conductive anode 25, electrically connected to the positive pole of electric power source 29, is arranged so as to at least partially surround magnet 23 and be approximately concentric therewith. Anode 25 may be fixed inside the housing by way of insulative ring 31 (e.g., of ceramic). Anode 25 defines a central opening therein in which magnet 23 is located. The negative pole of electric power source 29 is connected to cathode 5, so that the cathode is negative with respect to the anode (e.g., the cathode may be grounded in certain example non-limiting instances).

Generally speaking, the anode 25 may be biased positive by several hundred to a few thousand volts. Meanwhile, the cathode (inner and/or outer portions thereof) may be held at, or close to, ground potential. This is the during ion source operation.

The conventional ion beam source of FIGS. 1-3 is intended for the formation of a unilaterally directed tubular (in the case of a standard beam collimated mode for example) ion beam, flowing in the direction toward substrate 45. Substrate 45 may or may not be biased in different instances. The ion beam emitted from the area of slit/aperture 15 is in the form of an oval (e.g., race-track) in the FIG. 1-3 embodiment, although other shapes may be used.

The conventional ion beam source of FIGS. 1-3 can operate as follows in a depositing mode when it is desired to ion beam deposit a layer(s) on substrate 45. A vacuum chamber in which the substrate 45 and slit/aperture 15 are located is evacuated to a pressure less than atmospheric, and a depositing gas (e.g., a hydrocarbon gas such as acetylene, or the like) is fed into the interior of the source via gas aperture(s) 21 or in any other suitable manner. It is possible that the depositing gas may instead be introduced into the area between the slit 15 and substrate 45. A maintenance gas (e.g., argon) may also be fed into the source in certain instances, along with the depositing gas. Power supply 29 is activated and an electric field is generated between anode 25 and cathode 5 (including inner 5*a* and outer 5*b*), which accelerates electrons to high energy. Anode 25 is positively biased by several hundred to a few thousand volts, and cathodes 5*a* and 5*b* are at ground potential or proximate thereto as shown in FIG. 1. Electron collisions with the gas in or proximate aperture/slit 15 leads to ionization and plasma is generated. "Plasma" herein means a cloud of gas including ions of a material to be accelerated toward substrate 45. The plasma expands and fills (or at least partially fills) a region including slit/aperture 15. An electric field is produced in slit 15, oriented in the direction substantially perpendicular to the transverse magnetic field, which causes the ions to propagate toward substrate 45. Electrons in the ion acceleration space in and/or proximate slit/aperture 15 are propelled by the known E×B drift (Hall current) in a closed loop path within the region of crossed electric and magnetic field lines proximate slit/aperture 15. These circulating electrons contribute to ionization of the gas (the term "gas" as used herein means at least one gas), so that the zone of ionizing collisions extends beyond the electrical gap between the anode and cathode and includes the region proximate slit/aperture 15 on one and/or both sides of the cathode.

For purposes of example, consider the situation where a silane and/or acetylene ($C_2H_2$) depositing gas is/are utilized by the ion source of FIGS. 1-3 in a depositing mode. The silane and/or acetylene depositing gas passes through the gap between anode 25 and the cathodes 5*a*, 5*b*.

Unfortunately, ion sources suffer from the problem that during use the electrode(s) (e.g., cathode and/or anode) erode over time. For example, consider a situation where the cathode (or anode) is made of steel—which includes iron. During use of the ion source, exposed surface portions of at least the cathode are prone to erosion. This type of electrode erosion is problematic for a number of reasons. First, significant erosion of the cathode over time can cause the width of the slit (i.e., the magnetic gap) to significantly change which in turn can adversely affect ion beam processing conditions and lead to non-uniform coatings, etchings, etc. When enough erosion has occurred to cause the width of the slit/gap to sufficiently change, the electrode(s) have to be replaced with entire new electrode(s).

In view of the above, it will be appreciated that there exists a need in the art for an ion source (and/or corresponding method) that is capable of efficiently dealing with the issue of electrode erosion.

SUMMARY OF EXAMPLE EMBODIMENTS OF THE INVENTION

In certain example embodiments of this invention, there is provided an ion source including an anode and a cathode. In certain example embodiments, a multi-piece outer cathode is provided. The multi-piece outer cathode allows precision adjustments to be made, thereby permitting adjustment of the magnetic gap between the inner and outer cathodes. This allows improved performance to be realized, and/or prolonged operating life of certain components. This may also permit multiple types of gap adjustment to be performed with different sized outer cathode end pieces. In certain example embodiments, cathode fabrication costs may also be reduced.

In certain example embodiments of this invention, there is provided an ion source comprising: a conductive cathode comprising an inner cathode and an outer cathode; an ion emitting gap formed at least partially between the inner cathode and the outer cathode; an anode located proximate the ion emitting gap; and wherein the outer cathode comprises a plurality of electrically connected conductive pieces which are at least partially coplanar.

In other example embodiments of this invention, there is provided an ion source comprising: first and second electrodes, wherein the first electrode (e.g., cathode) comprises an inner electrode and an outer electrode that are spaced apart from one another; an ion emitting gap formed at least partially between the inner electrode and the outer electrode; the second electrode (e.g., anode) being located proximate the ion emitting gap; and wherein the outer electrode comprises a plurality of electrically connected conductive pieces which are at least partially coplanar.

BRIEF DESCRIPTION OF THE DRAWINGS

FIG. 4(*b*) is a side plan view of the outer cathode of FIG. 4(*a*).

FIG. 4(*c*) is a cross sectional view taken along section line C-C' of FIG. 4(*a*).

DETAILED DESCRIPTION OF CERTAIN EXAMPLE EMBODIMENTS OF THE INVENTION

Figure 1:
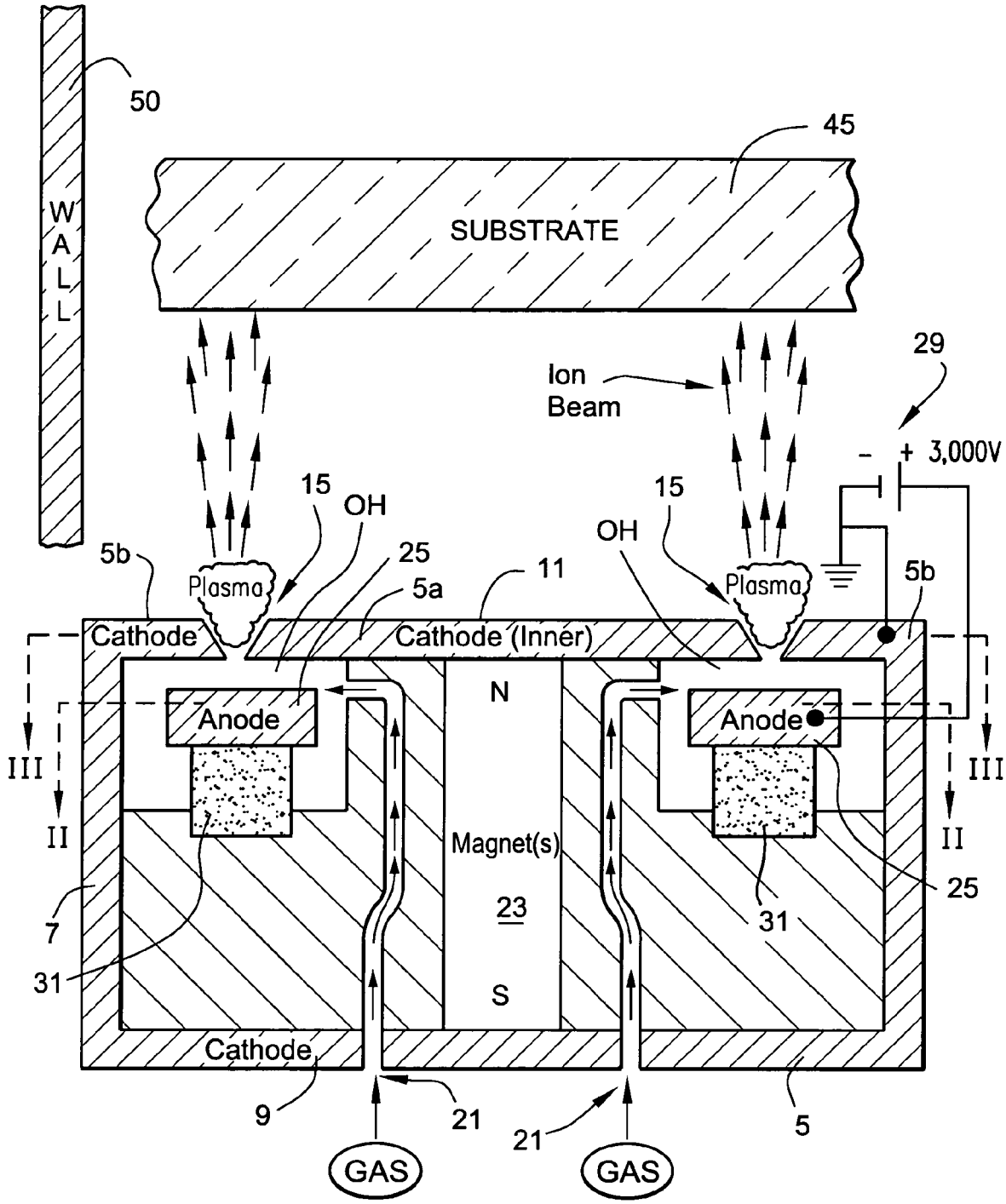
Fig. 1 (PRIOR ART)
FIG. 1 is a schematic partial cross sectional view of a conventional cold cathode closed drift ion source.

Referring now more particularly to the accompanying drawings, in which like reference numerals indicate like parts throughout the several views (unless otherwise indicated). In this respect, for example, reference numerals used in FIGS. 4-7 may be used for the same components discussed above with respect to FIGS. 1-3.

In the following description, for purposes of explanation and not limitation, specific details are set forth in order to provide an understanding of certain embodiments of the present invention. However, it will apparent to those skilled in the art that the present invention may be practiced in other embodiments that depart from these specific details. In other instances, detailed descriptions of well known devices, gases, fasteners, and other components/systems are omitted so as to not obscure the description of examples of the present invention with unnecessary detail.

Certain example embodiments of this invention relate to an ion source having a multi-piece outer cathode. The multi-piece outer cathode allows precision adjustments to be made, thereby permitting adjustment of the magnetic gap between the inner and outer cathodes for example. This allows improved performance to be realized, and/or prolonged operating life of certain components. This may also permit multiple types of gap adjustment to be performed with different sized outer cathode pieces. In certain example embodiments, cathode fabrication costs may also be reduced. The ion source in certain example embodiments may be a cold cathode closed drift ion source. Operating pressures may be below atmospheric pressure, and may be similar to those of planar and magnetron sputtering systems.

Figure 3:
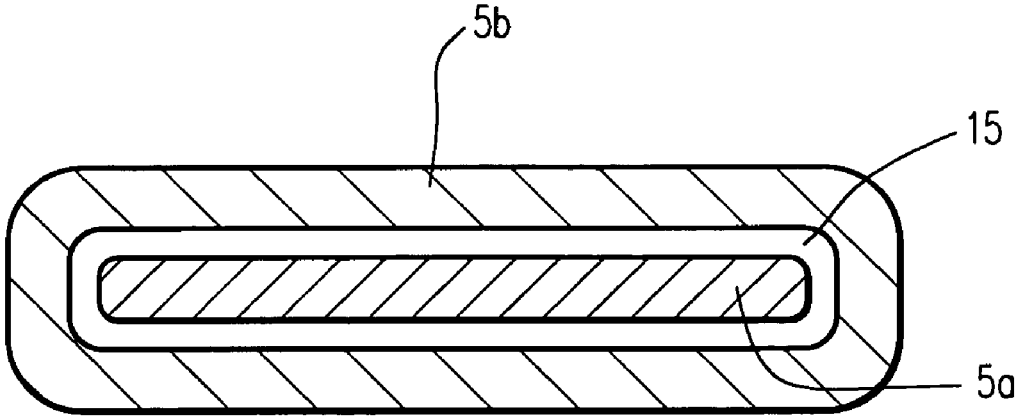
Fig. 3 (PRIOR ART)
FIG. 3 is a sectional view taken along section line III of FIG. 1.
Figure 4A:
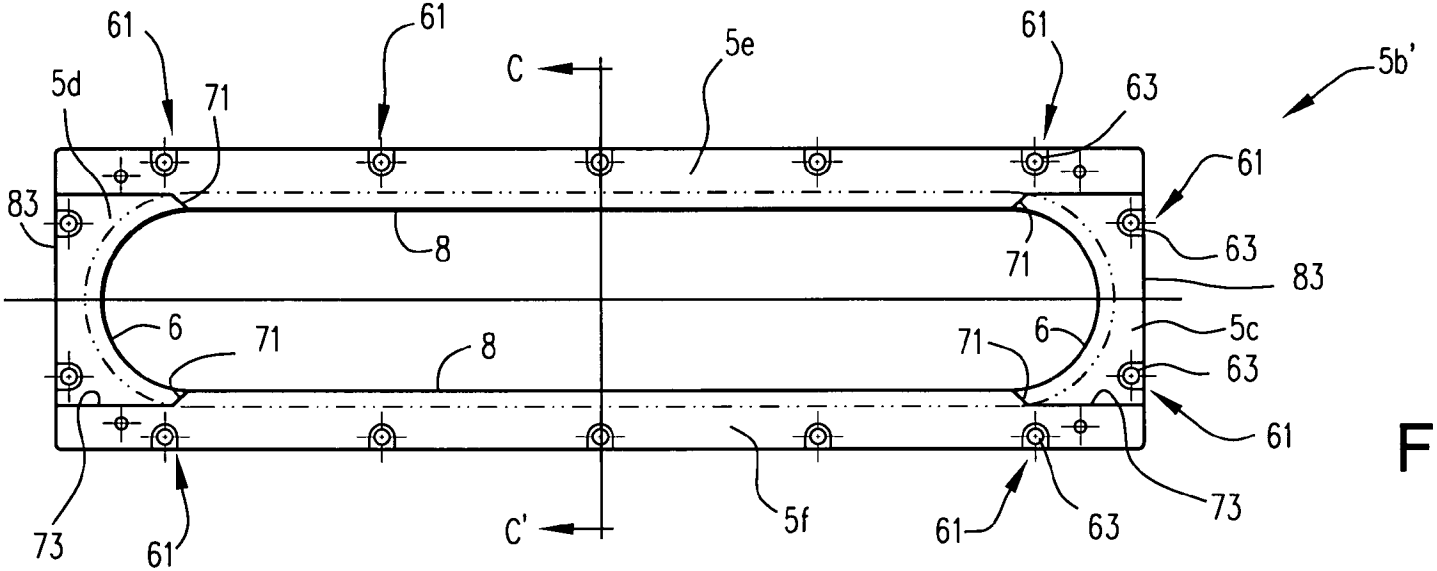
FIG. 4(*a*) is a top plan view of a multi-piece outer cathode according to an example embodiment of this invention.
Figure 4C:
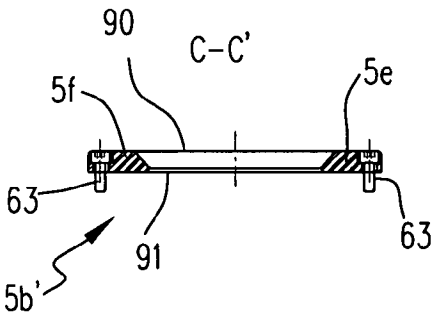
Figure 4B:
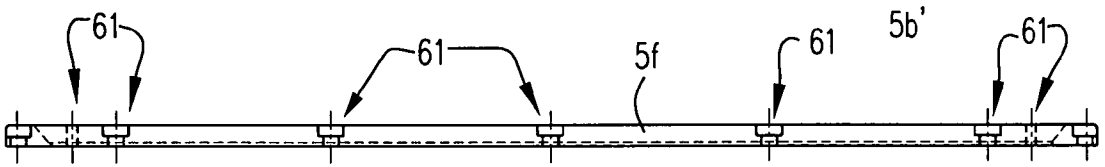

FIG. 4 illustrates an example multi-piece outer cathode 5*b*' that may be used in an ion source in certain example embodiments of this invention. This multi-piece outer cathode 5*b*' may be used in the ion source of FIGS. 1-3, or in the ion source of FIG. 7, or in any other suitable ion source in different embodiments of this invention. FIG. 4(*a*) is a top plan view of the multi-piece outer cathode 5*b*', while FIG. 4(*b*) is a side plan view of the multi-piece outer cathode 5*b*' and FIG. 4(*c*) is a cross sectional view taken along section line C-C' of FIG. 4(*a*).

An ion source using the multi-piece cathode 5*b*' of FIG. 4 may include both inner cathode 5*a* and multi-piece outer cathode 5*b*'. The outer cathode 5*b*' may surround or substantially surround the inner cathode 5*a* in certain example embodiments of this invention (e.g., see FIG. 3), and the two may be coaxial in certain example instances. The inner and outer cathodes 5*a* and 5*b*' may be of the same conductive material in certain embodiments, although this invention is not so limited unless expressly claimed. The cathodes may be circular or oval shaped in different example embodiments of this invention. Between the inner and outer cathodes 5*a* and 5*b*', respectively, there is provided an ion emitting gap or slit 15 which includes an inner periphery defined by the periphery of the inner cathode 5*a* and an outer periphery defined by the inner periphery of the outer cathode 5*b*' (e.g., see FIGS. 3 and 7).

The ion beam emitted from the ion source may be a diffused beam in certain example embodiments of this invention. However, in other example embodiments, the ion beam from the ion source may be focused or otherwise shaped/oriented.

Figure 5:
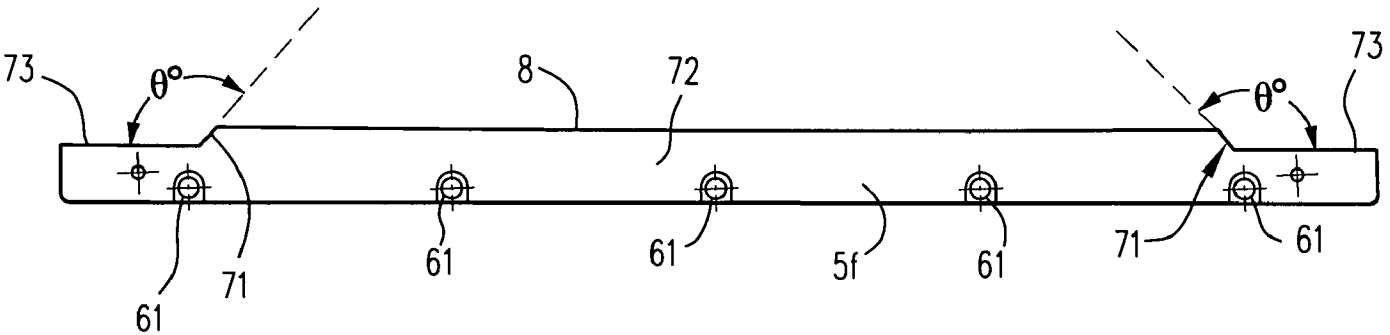
FIG. 5 is a top plan view of one of the elongated outer cathode pieces of the multi-piece outer cathode of FIG. 4.
Figure 6:
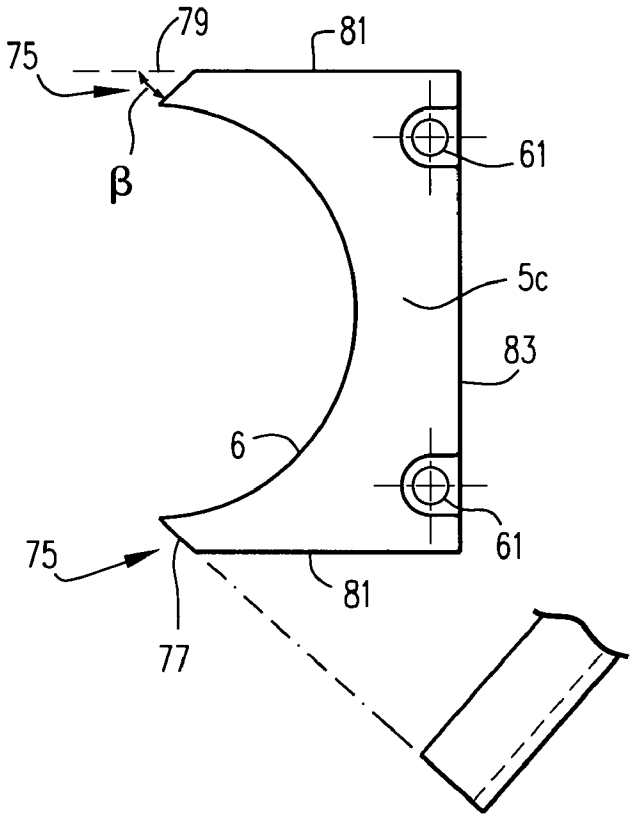
FIG. 6 is a top plan view of one of the end pieces of the multi-piece outer cathode of FIG. 4.
Figure 7:
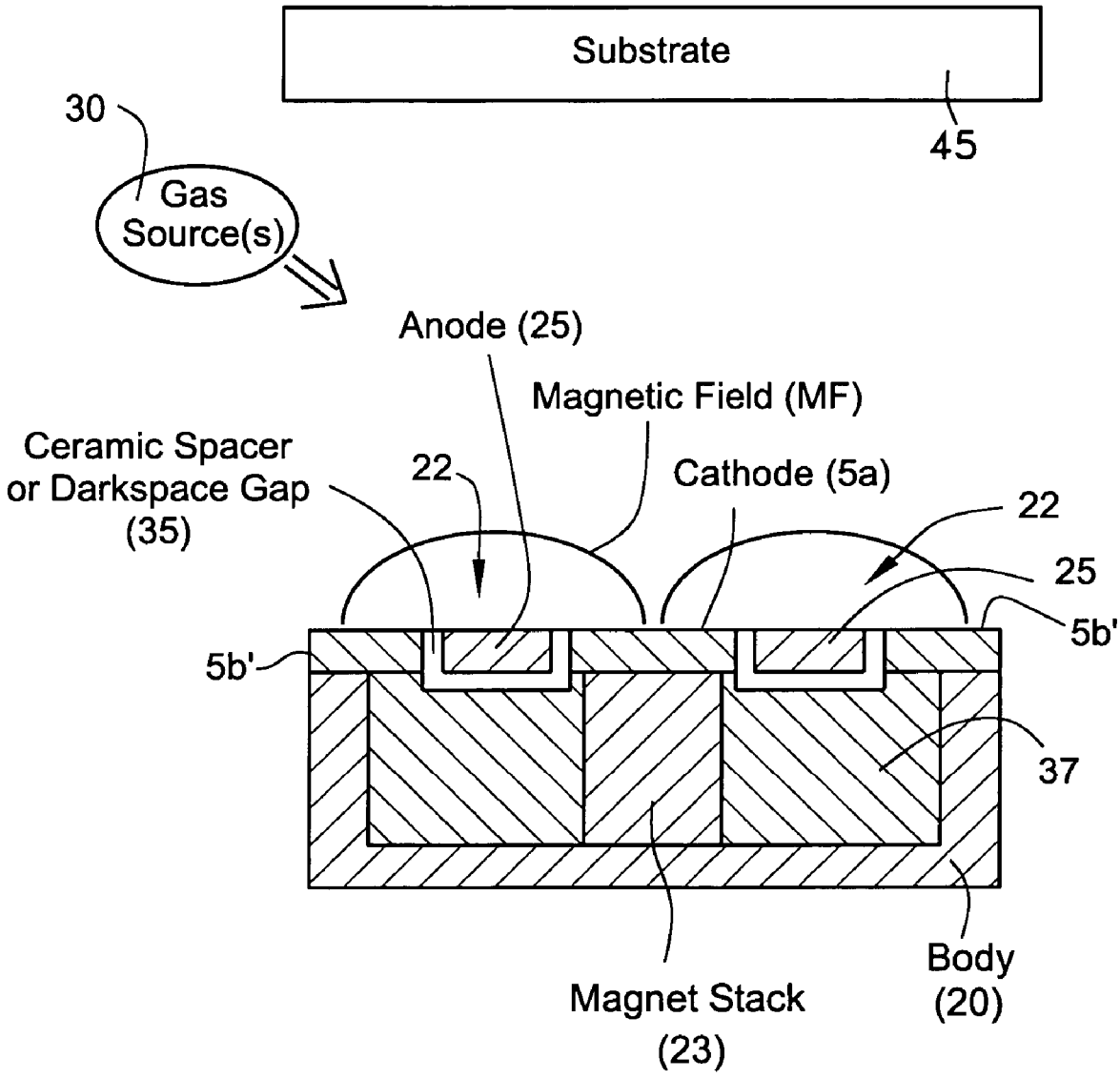
FIG. 7 is a cross sectional view of an example non-limiting ion source in which the multi-piece outer cathode of FIGS. 4-7 may be used.

FIG. 4(*a*) illustrates that the multi-piece outer cathode 5*b*' includes four different conductive pieces, namely opposing end pieces 5*c* and 5*d*, and opposing side pieces 5*e* and 5*f*. FIG. 5 is a top view of piece 5*f*, and FIG. 6 is a top view of piece 5*c*. Each of the conductive pieces 5*c*, 5*d*, 5*e* and 5*f* of the outer cathode 5*b*' includes one or more apertures 61 defined therein so as to allow screws or other types of fasteners 63 to be used to attach the piece(s) to the underlying body 20 of the ion source (an example body 20 is shown in FIG. 7). In certain example embodiments, each of the conductive pieces 5*c*, 5*d*, 5*e* and 5*f* of the multi-piece outer cathode 5*b*' includes at least two such apertures 61 defined therein. As best shown in FIG. 4(*a*), the end pieces 5*c* and 5*d* are at the respective ends of the racetrack-shaped ion source, whereas the opposing side pieces 5*e* and 5*f* are along the respective elongated sides of the ion source, so that the four pieces 5*c*, 5*d*, 5*e* and 5*f* together define an outer periphery of the ion emitting slit/gap 15. For purposes of simplicity and understanding, the inner cathode 5*a* is not shown in FIG. 4 (but the slit/gap 15 between the inner anode 5*a* and the multi-piece outer cathode 5*b*' is the same as shown in FIG. 3).

In certain example embodiments of this invention, outer cathode pieces 5*c*, 5*d*, 5*e* and 5*f* may be made of a conductive material such as stainless steel (e.g., 1012 hot rolled steel, or mild steel), although other materials may also be used. In certain example embodiments, each of the pieces 5*c*, 5*d*, 5*e* and 5*f* may have a thickness of from about 3-25 mm, more preferably from about 4-15 mm, with an example thickness being about 7 mm. In certain example embodiments, pieces 5*c*, 5*d*, 5*e* and 5*f* all have substantially the same thickness.

In certain example embodiments, the inner edge/side 6 of each end piece 5*c* and 5*d* which helps define the ion emitting slit/gap 15 is arc-shaped, whereas the inner edge/side 8 of each side piece 5*e* and 5*f* which helps define the slit/gap 15 is linear-shaped. In certain example embodiments, the side 6 of each end piece 5*c* and 5*d* which helps define the ion emitting slit/gap 15 is in the shape of an approximate half-circle. In certain example embodiments, the inner sides/edges 8 of the respective side pieces 5*e* and 5*f* are substantially parallel to one another. In certain example embodiments, each end piece (5*c*, 5*d*) is located between and directly contacts side pieces 5*e*, 5*f*. In certain example embodiments, each side piece (5*e*, 5*f*) is located between and directly contacts end pieces 5*c*, 5*d*.

As best shown in FIGS. 4(*a*) and 5, the inner edge or side 8 of each side piece (5*e* and/or 5*f*) includes first and second angled portions 71. Each angled portion 71 includes a surface which defines an angle θ with an adjacent side portion 73 of the side piece (where the adjacent side portion 73 does not help define the ion emitting slit/gap). The portion 72 between the angled portions 71 on a given side piece can be considered a protrusion since it protrudes from the side portions 73 of the side piece which do not help define the ion emitting slit/gap. Angle θ is preferably from about 110 to 170 degrees, more preferably from about 120 to 160 degrees, with an example being about 135 degrees. This back relief angle θ defined by angled portion 71 is significant in that it reduces or prevents a hot glow (e.g., clustering of ions or plasma cloud) from occurring at the respective interfaces between the end pieces (5*c*, 5*d*) and the side pieces (5*e*, 5*f*). The use of this angled portion 71 to reduce the likelihood of a plasma cloud forming at the interface between adjacent pieces in turn reduces the possibility of the outer cathode melting or otherwise being damaged at these interface locations.

The angled portions 71 of the side pieces 5*e* and 5*f* abut and/or are adjacent to respective angled portions 75 of the end pieces 5*c* and 5*d* (e.g., see FIG. 6). Angled portions 75 of the end pieces 5*c*, 5*d* each comprise a surface 77 that defines an angle β with an imaginary extension 79 of an outer edge 81 of the end piece 5*c*, 5*d* (e.g., see FIG. 6). Angle β may be from about 20 to 70 degrees in certain example embodiments, more preferably from about 30 to 60 degrees, with an example being about 45 degrees. In certain example embodiments of this invention, outer edges 81 of each end piece 5*c*, 5*d* define an approximate right angle with end edge 83.

As best shown at the bottom of FIG. 6, each surface 77 of a respective angled portion 75 is angled through the thickness of the end piece. In particular, a degree of relief is provided along surface 77 so as to ensure good electrical and mechanical contact between the end pieces (5*c*, 5*d*) and adjacent side pieces (5*e*, 5*f*). Thus, the top 90 (major surface closest to the substrate at which ions are directed) of the end piece (5*c* and/or 5*d*) at surface 77 is closer to the surface 71 of the adjacent side piece (5*e* and/or 5*f*) than is the bottom 91 of the end piece. This is advantageous in that by ensuring good contact between the end and side pieces, the generation of significant plasma clouds at the interface locations can be reduced and/or prevented thereby reducing the possibility of the outer cathode melting or otherwise being damaged at these interface locations.

Given the multiple pieces 5*c*, 5*d*, 5*e* and 5*f* making up the outer cathode 5*b*', four-way dynamic adjustability of the ion emitting slit/gap 15 can be realized in certain example embodiments of this invention. In particular, given angled portions 71 and 75, each of the pieces 5*c*, 5*d*, 5*e* and 5*f* can have its position relative to the ion emitting slit/gap 15 adjusted. In other words, each of these pieces can be moved inwardly or outwardly, thereby adjusting the size of the gap. Thus, four-way adjustability can be realized. For example and without limitation, when the anode and cathode wear down (erode) during use of the ion source and the size of the slit/gap 15 between the inner and outer cathodes becomes undesirably large, the end pieces 5*c* and/or 5*d* may be replaced with end pieces of a slightly smaller size, while maintaining the side pieces 5*e* and 5*f*. After the new end pieces 5*c* and/or 5*d* have been inserted (they may have a smaller width than the previous pieces—from top to bottom as viewed in FIG. 4(*a*)), the side pieces 5*e* and 5*f* can be moved inwardly toward the slit so as to adjust the width of the racetrack-shaped ion emitting slit/gap 15. Thus, as the inner cathode 5*a* becomes smaller, the inner periphery of the outer cathode 5*b*' can be progressively adjusted inwardly so as to maintain a desired size of the ion emitting slit/gap 15 that is defined between the inner and outer cathodes. An example desired width of the slit/gap 15 is from about 1 to 3 mm, more preferably about 2 mm.

Figure 2:
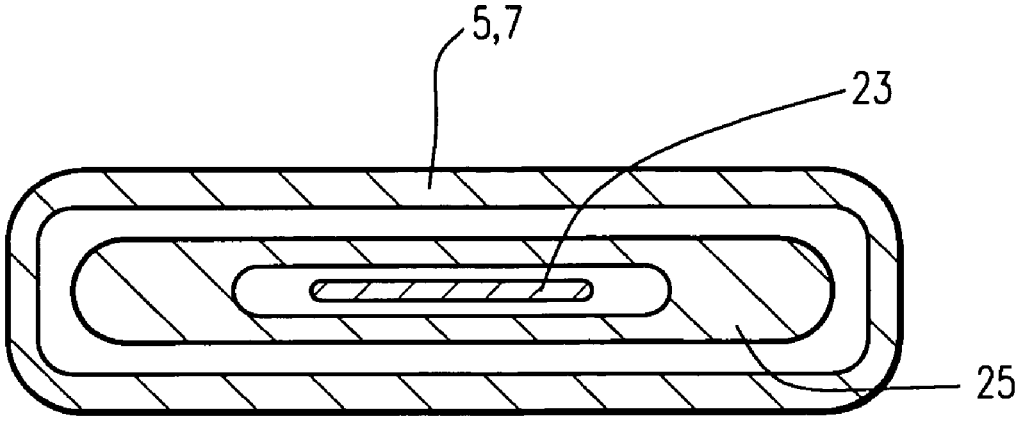
Fig. 2 (PRIOR ART)
FIG. 2 is a sectional view taken along section line II of FIG. 1.

The multi-piece outer cathode 5*b*' discussed above and shown in FIGS. 4-6 may be used in the FIG. 1-3 type of ion source, or in any other suitable type of ion source. For example and without limitation, the multi-piece outer cathode 5*b*' discussed above and shown in FIGS. 4-6 may be used in the ion sources of any of U.S. Pat. Nos. 6,359,388; 6,037,717; 6,002,208; 5,656,819, 6,815,690, Ser. Nos. 10/986,456, and 10/419,990, the disclosures of which are all hereby incorporated herein by reference.

FIG. 7 is a cross sectional view of a cold cathode closed drift type ion source according to another example embodiment in which the multi-piece outer cathode 5*b*' may be used (although it may of course be used in a source as shown in FIG. 1 or in any other suitable type of ion source as discussed above). In this embodiment, the anode 25 is at least partially coplanar with the cathode 5 (see inner cathode 5*a* and outer cathode 5*b*'). Thus, adjustments of the pieces of the outer cathode 5*b*' in the FIG. 6 embodiment adjust the gap between the outer cathode and the inner cathode, as well as the gap between the cathode and anode. In this embodiment, an adjustable ion emitting gap 22 is formed at least partially between the inner cathode portion 5*a* and the outer cathode portion 5*b*' as viewed from above or below (e.g., as viewed from the substrate). In the FIG. 7 embodiment, heat sink 37 of a material such as copper may be provided below the insulator 35, and the insulator 35 may electrically insulate the anode 25 from the heat sink 37. In the FIG. 7 embodiment, like the embodiment shown in FIGS. 1-3, an ion emitting gap 22 (or 15 in the FIG. 1-3 embodiment) is formed at least partially between the inner cathode 5*a* and the outer cathode 5*b*', and the anode 25 is located at least partially between the inner cathode 5*a* and the outer cathode 5*b*' as viewed from above and/or below.

In the aforesaid embodiments it is noted that the magnetic stack 23 is illustrated in the center of the source. However, this need not be the case in alternative embodiments, as the central location is used for convenience only and is not a requirement in all instances. It is further noted that the absolute polarity of the magnetic field (North vs. South) is not particularly important to the function of the source. Moreover, it is possible that a ceramic insulator 35 or dark-space gap may be provided between the anode and cathode in certain example instances. In this embodiment or in other embodiments, a gas source 30 may be provided so that gas such as acetylene or the like may be introduced toward the source from the side thereof closest to the substrate 45 (e.g., glass substrate to be milled or coated). Moreover, the positions of the anode and cathode may be switched in certain alternative instances.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. An ion source comprising:

a conductive cathode comprising an inner cathode and an outer cathode;

an ion emitting gap formed at least partially between the inner cathode and the outer cathode;

an anode located proximate the ion emitting gap;

wherein the outer cathode comprises first, second, third and fourth electrically connected conductive pieces which are at least partially coplanar, wherein each of the first, second, third and fourth conductive pieces of the outer cathode abuts, is substantially coplanar with at at least one major surface thereof, and directly contacts two of the other of said conductive pieces of the outer cathode; and wherein an abutting interface between the second and third conductive pieces is angled so as to define an angle θ of from about 110-170 degrees with a portion of the ion emitting gap at said abutting interface.

2. The ion source of claim 1, wherein the first and second conductive pieces of the outer cathode are end pieces each having an arc-shaped inner edge which at least partially defines the ion emitting gap.

3. The ion source of claim 2, wherein the end pieces do not physically contact each other.

4. The ion source of claim 3, wherein the third and fourth pieces of the outer cathode are side pieces, each of which is located at least partially between the end pieces.

5. The ion source of claim 4, where the side pieces of the outer cathode comprise respective inner edges which at least partially define the ion emitting gap and which are substantially parallel to each other.

6. The ion source of claim 4, wherein the end pieces, and the side pieces, are all at least partially provided in a common plane.

7. The ion source of claim 1, wherein an area between the anode and the cathode is provided with a ceramic insulator.

8. The ion source of claim 1, further comprising at least one magnet at least partially located adjacent the inner cathode portion and located in an aperture defined in the anode as viewed from above and/or below.

9. The ion source of claim 1, wherein the ion source is a cold cathode closed drift ion source.

10. The ion source of claim 1, wherein the inner cathode and the outer cathode are of the same conductive material.

11. An ion source comprising:

first and second electrodes, wherein the first electrode comprises an inner electrode and an outer electrode that are spaced apart from one another;

an ion emitting gap formed at least partially between the inner electrode and the outer electrode;

the second electrode being located proximate the ion emitting gap; and wherein the outer electrode comprises first, second, third and fourth electrically connected conductive pieces, wherein each of the first, second, third and fourth conductive pieces of the outer electrode is adjustable and can be adjusted toward and/or away from the ion emitting gap so that four-way adjustability can be realized, and wherein an interface between the second and third conductive pieces is angled relative to an immediately adjacent edge of the ion emitting gap, and an interface between the first and fourth conductive pieces is angled relative to an immediately adjacent edge of the ion emitting gap.

12. The ion source of claim 11, wherein the first and second conductive pieces of the outer electrode are end pieces, wherein each of the end pieces has an arc-shaped inner edge which at least partially defines the ion emitting gap.

13. The ion source of claim 12, wherein the end pieces do not physically contact each other.

14. The ion source of claim 13, wherein the third and fourth pieces of the outer electrode are side pieces, each of which is located at least partially between the end pieces.

15. The ion source of claim 11, wherein the first electrode is a cathode, and the second electrode is an anode of the ion source.

16. The ion source of claim 14, where the side pieces of the outer electrode comprise respective inner edges which at least partially define the ion emitting gap and which are substantially parallel to each other.

17. The ion source of claim 11, wherein the ion source is a cold cathode closed drift ion source.

18. The ion source of claim 1, wherein said abutting interface between the second and third conductive pieces is angled so as to define an angle θ of from about 120-160 degrees with the portion of the ion emitting gap at said abutting interface.

19. The ion source of claim 1, wherein said abutting interface between the second and third conductive pieces is angled so as to define an angle θ of from about 120-160 degrees with an adjacent side portion of the third conductive piece, the adjacent side portion of the third conductive piece being parallel to a side of the third conductive piece defining an edge of the ion emitting gap at said abutting interface.

* * * * *